United States Patent [19]

Johne

[11] 4,231,155

[45] Nov. 4, 1980

[54] ELECTRICALLY POWERED PAINT SCRAPING TOOL

[76] Inventor: Bruce Johne, 211 Ramsay Alley, Alexandria, Va. 22314

[21] Appl. No.: 37,664

[22] Filed: May 10, 1979

[51] Int. Cl.[3] ..... A47L 11/12

[52] U.S. Cl. ..... 30/169; 30/123.3

[58] Field of Search ..... 30/169, 123.3, 272

[56] References Cited

U.S. PATENT DOCUMENTS

| | | | |
|---|---|---|---|
| 2,722,072 | 11/1955 | Aspeek | 30/169 |
| 2,984,005 | 5/1961 | Evich | 30/169 X |
| 3,195,232 | 7/1965 | Toth | 30/169 |
| 3,377,702 | 4/1968 | Aspeek | 30/169 |
| 3,468,384 | 9/1969 | Bodine | 30/169X |
| 3,530,577 | 9/1970 | Franklin | 30/169 |
| 3,832,772 | 9/1974 | Sumida | 30/123.3 |

*Primary Examiner*—Jimmy C. Peters

*Attorney, Agent, or Firm*—Wilkinson, Mawhinney & Theibault

[57] ABSTRACT

The object of the invention is to provide a portable hand operated electrically powered paint scraper compact, sturdy maneuverable and with a positive reliable drive to reciprocate a scraping blade the working surface of which may be both protected and regulated.

Another object of the invention is to convert the rotary drive of an electric motor into a reciprocating motion of a blade holder with a dual drive linkage system.

Another object of the invention is the provision of a dual linkage drive system which will apply maximum thrust to the working blade and working thrust even should one of the linkage units of the drive fail.

A further object of the invention is the provision of a tool as above described including its own internal blower system to cause material removed by the blade to be blown away from the work area.

7 Claims, 4 Drawing Figures

ELECTRICALLY POWERED PAINT SCRAPING TOOL

TECHNICAL FIELD

My invention relates to paint scraping tools of the electrical type which are powered by an electric motor whose rotary power is converted into a reciprocating action on a sharp edge such as a razor blade.

Paint scrapers, particularly of the window type to safely do the job and protect the window supporting surface such as a frame must simulate the action of a single edge razor blade in the hand of a human being, be faster and capable of prolonged operation. My invention is not limited to removing paint from windows adjacent their frames but in scraping a hardened material from a surface in an unwanted area.

BACKGROUND ART

Heretofore many forms of apparatus have been devised to convert the rotary action of the output shaft of an electric motor into reciproacting action to operate a work tool. The closest art known to me prior to this application are: the patent to David Toth, U.S. Pat. No. 3,195,232; U.S. Pat. No. 1,898,956 to W. E. Harvie; U.S. Pat. No. 3,285,136 to W. Wezel, and U.S. Pat. No. 3,337,954 to R. O. Robinson.

DISCLOSURE OF THE INVENTION

In accordance with my invention I provide an injection molded plastic casement with a pistol grip at one end and a working area at the other end. The casement forms a support in which is mounted an electric drive motor, motor action conversion mechanism for converting rotary motion into reciprocating motion. The working end of the tool has a nose through which projects a flat sharp edge or blade such as a razor blade, which is reciprocated to and fro along the major axis of the casement relative to which the working plane of the blade is at a right angle. Blade cleaning elements are positioned to remove with the assistance of a blown air stream the paint or other substances from the razor blade removed from the window or surface being cleaned. An adjustable shield or guard regulates the amount of blade to be exposed to protect the support area around the area being cleaned. The size of the unit is not much larger than large hair clippers or animal clipping shears, is light in weight for one-hand use, portable and maneuverable into and out of tight or restricted areas.

The pivoted linkage system for converting the output of the motor from rotary to reciprocating action is a dual system which guards against total failure and applies an even thrust to the blade or work surface.

BEST MODE FOR CARRYING OUT THE INVENTION

Figure 1:
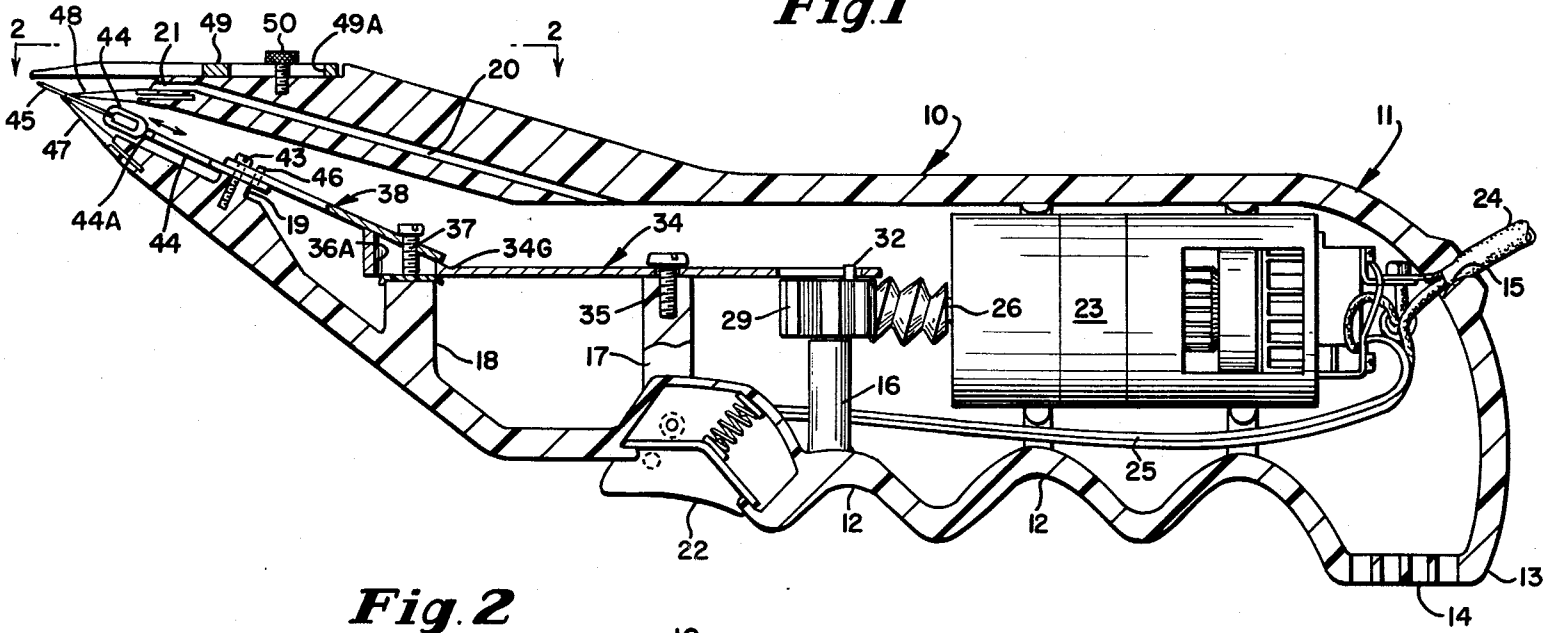
FIG. 1 is a vertical longitudinal section taken through my electrically powered paint scraping tool.

Referring now to FIG. 1, 10 designates generally a support casement which may be formed in two halves of a high impact injection molded plastic. A pistol grip handle 11 has finger gripping grooves 12 and the butt 13 of the grip 11 has an air screen opening 14. An opening 15 permits passage of a power cord. Each half of the casement 10 has four pivot posts 16, 17, 18 and 19. An air passage 20 is provided to communicate air from within the casement 10 to an external discharge 21 at the blade end of the casement. A spring loaded trigger 22 is located just forwardly of the pistol grip handle 11.

An electric motor 23 is secured in the casement on mounts and is connected to a power cord 24. An operating lead 25 is connected between the trigger 22 and the motor 23.

Figure 3:
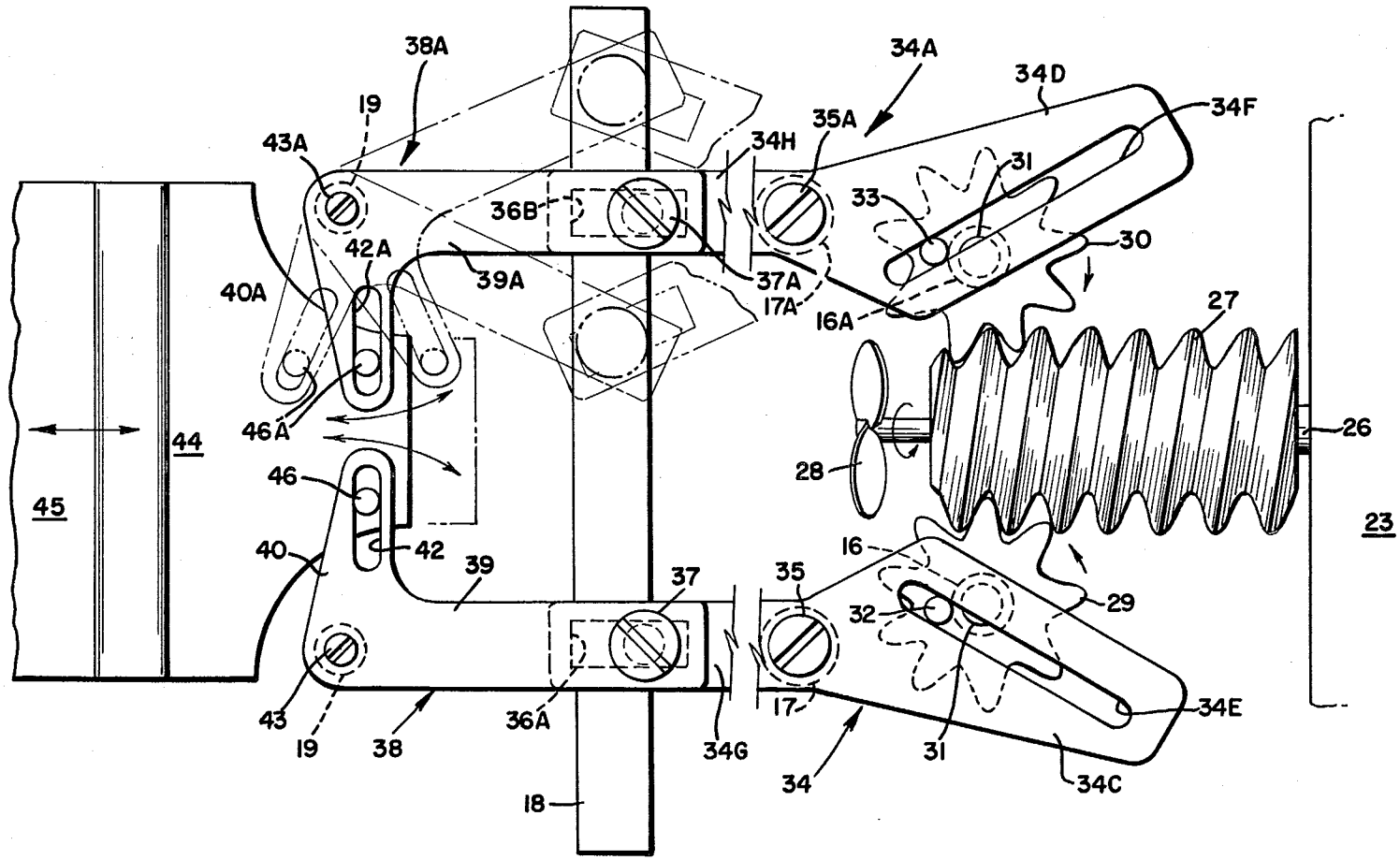
FIG. 3 is an enlarged schematic of the apparatus of my paint scraping tool showing in detail the conversion mechanism for converting rotary to reciprocating drive.

As best seen in FIGS. 1 and 3, the motor output shaft 26 has a drive worm 27 connected to be driven thereby as well as a fan 28.

Figure 4:
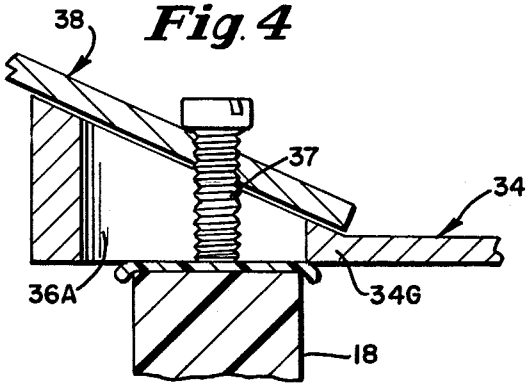
FIG. 4 is a fragmentary enlarged side elevational view of the pivotal joining of the primary and secondary arms of the mechanical conversion mechanism.

At each side of the worm gear are worm pinions 29,30 which are pivoted at 31 to posts 16. Upstanding from each worm pinion 29,30 are drive pins 32,33. The next link in the drive train are a pair of primary arms 34 and 34A which are pivoted at 35,35A to posts 16,16A. At the rear of the primary arms are angled slot plates 34C and 34D having angularly disposed slots 34E and 34F therein in which drive pins 32,33 ride. Forwardly of pivots 35,35A the primary arms have upturned ends 34G and 34H which have slots 36A and 36B therein. A pivot guide 37,37A rest upon posts 18. As seen in FIGS. 3 and 4, the guides 37,37A are smaller than the slots 36A,36B to permit the action indicated by the arrows.

Located forwardly of the primary arms 34,34A are secondary arms 38,38A in the shape of a bell crank having legs 39,39A and feet 40,40A. Proximate the free end of the legs 39,39A the pivot pins 37,37A pass through the slots 36A,36B of the primary arms 34,34A as best seen in FIGS. 3 and 4. Located in the feet 40,40A of the bell cranks are slots 42,42A. The pivot of the secondary arms 38,38A are at 43,43A which are in posts 19.

The blade holder is pivoted at 44A to permit the blade as it engages the working surface to ride upwardly along and not into the working surface. The blade holder 44 also has a slot for transversely receiving a razor blade 45 at its front end and a pair of drive pins 46,46A at its top rear. The pins 46,46A ride in the slots 42,42A in the feet of the secondary arms 38,38A, to reciprocate the blade holder as shown by the arrows.

Positioned above and below the razor blade 45 are blade cleaners 47,48, which are below the discharge of the air passage 20 which blows the scraped material from the blade area.

Figure 2:
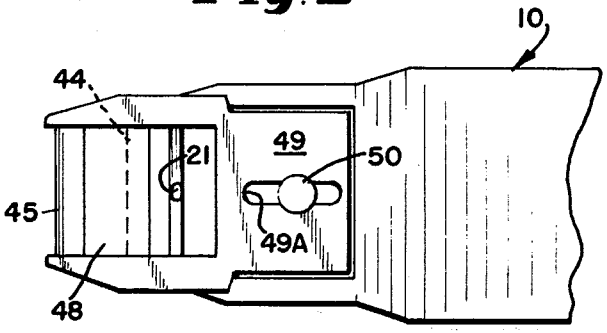
FIG. 2 is a top plan view of the front or working end of the tool showing the adjustable shield or guard for the blade.

As best seen in FIGS. 1 and 2 a blade guide 49 is adjustably secured by an adjusting screw 50 to determine the amount of blade exposure to protect the area surrounding the immediate blade work area. The guide 49 has a slot 49A to permit back and forth adjustment relative to adjusting screw 50.

IN OPERATION

With the power lead 24 connected to a source of electrical power the casement 10 is taken in the hand of the user by grasping the pistol grip 11 with the fingers about the gripping grooves 12, the trigger 22 is pulled causing the motor 23 to rotate the worm 27 which drives worm pinions 29,30. The pins 33 secured to the worm gears move in the slots 34E and 34F which cause the primary arms 34,34A to move back and forth about pivots 35 and 35A which cause 34C and 34D to move the secondary arms 38 and 38A to move about pivots 43,43A and drive the blade holder 44 carrying razor blade 45 back and forth in a reciprocating action. The movement of each element in the drive train is indicated by arrows. The blade guide 49 is set to give the right amount of blade exposure with respect to the surface to be scraped and to protect the adjacent supporting area of the surface being scraped. This is accomplished by selectively setting the adjusting screw 50.

As the razor blade 45 removes paint on a window adjacent the frame holding same, the blower fan 28 driven by the motor 23 will cause air to be forced through air passage 20 and as seen from FIG. 1, be directed to the area 21 where the razor blade 45 is moving back and forth between the blade cleaners 47,48 which blows the scraped paint away from the work area giving the user a clear view of the work area and an opportunity to assure complete removal of paint as the work progresses. The flow of air through the tool is from the air screen intake 14 at the butt of the pistol grip, through the interior of the casement under power of the fan 28, through passage 20 to discharge 21.

What is claimed is:

1. An electric paint scraping tool comprising:

(a) a support casement, (b) an electric motor mounted in said casement having a rotary drive shaft extending therefrom, (c) a worm gear secured to said drive shaft, (d) a pair of worm pinions in mesh with said worm gear, (e) a pair of primary arms pivotally mounted to said casement and connected to be driven by said worm pinions at one side of said pivot and having a slotted end at the other side of said pivot, (f) a blade holder member, (g) a pair of L-shaped bell crank secondary arms pivotally mounted to said blade holder member proximate the juncture of the leg and foot of said L-shaped bell crank and connected to reciprocatingly drive said blade holder member, (h) said secondary bell crank arms being connected to be driven by said primary arms, (i) a razor blade mounted on the free end of blade holder member, (j) a blade limiting guard adjustably mounted on said casement and positioned to limit the operating surface of the blade to protect support surfaces of the area to be cleaned by said razor blade, (k) and trigger switch means carried by said casement and connected in circuit with said electric motor to start and stop said motor.

2. A paint scraping tool as claimed in claim 1 wherein each of said primary arms have slot drive plates each having a first slot at one end, said primary arms having a second slot at their other end to receive the free end of said pivot pin extending from the free end of the leg of said L-shaped secondary arms to drive said blade holder member, said slot drive plates being slotted to be driven by pins upstanding from said worm pinions.

3. A paint scraping tool as claimed in claim 2 wherein said L-shaped bell crank secondary arms have a pivot pin secured to the free end thereof to engage the second slot in said primary arms and have a slot in the foot of said L-shaped bell crank in which a drive pin upstanding from said blade holder member passes to reciprocate said blade holder.

4. A paint scraping tool as claimed in claim 3 wherein said pairs of primary and secondary arms are parallel and spaced apart from one another with the feet of said L-shaped bell cranks opposing one another.

5. A paint scraping tool as claimed in claim 4 wherein said support casement has three pivot support posts for carrying the pivots between said primary and secondary arms.

6. A paint scraping tool as claimed in claim 5 wherein said support casement has a pistol grip at its rear behind said trigger switch means.

7. A paint scraping tool as claimed in claim 6 wherein said support casement is an enclosed pistol-like support structure having an air intake opening at the butt of the pistol grip and an air duct discharging in the working area of the blade holder member, and a fan driven by the worm gear to draw air through the casement from the butt end of the pistol grip through said air duct to be directed upon the blade holder to blow paint scrapings removed from the work surface away from the blade holder area.

* * * * *